US007534536B2

(12) United States Patent
Lin et al.

(10) Patent No.: US 7,534,536 B2
(45) **Date of Patent: *May 19, 2009**

(54) POLYARYLATE CONTAINING MEMBER

(75) Inventors: Liang-Bih Lin, Rochester, NY (US); Daniel V. Levy, Rochester, NY (US); Jin Wu, Webster, NY (US); Francisco J. Lopez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 45 days.

This patent is subject to a terminal disclaimer.

(21) Appl. No.: 11/496,923

(22) Filed: Aug. 1, 2006

(65) Prior Publication Data

US 2008/0032221 A1 Feb. 7, 2008

(51) Int. Cl.
*G03G 5/14* (2006.01)

(52) U.S. Cl. ..... 430/60; 430/65; 430/63; 430/58.8; 430/58.75; 430/59.4

(58) Field of Classification Search ..... 430/64, 430/65, 58.8, 58.75, 59.4
See application file for complete search history.

(56) References Cited

U.S. PATENT DOCUMENTS

| | | | | |
|---|---|---|---|---|
| 4,265,990 | A | | 5/1981 | Stolka et al. |
| 4,464,450 | A | | 8/1984 | Teuscher |
| 4,921,769 | A | | 5/1990 | Yuh et al. |
| 5,385,796 | A | | 1/1995 | Spiewak et al. |
| 5,449,573 | A | | 9/1995 | Aoki et al. |
| 5,473,064 | A | | 12/1995 | Mayo et al. |
| 5,686,215 | A | * | 11/1997 | Bergfjord et al. ..... 430/59.4 |
| 5,928,824 | A | | 7/1999 | Obinata et al. |
| 5,932,385 | A | * | 8/1999 | Takamura et al. ..... 430/63 |
| 6,015,645 | A | | 1/2000 | Murti et al. |
| 6,156,468 | A | | 12/2000 | Wehelie et al. |
| 6,177,219 | B1 | | 1/2001 | Yuh et al. |
| 6,180,309 | B1 | | 1/2001 | Maty et al. |
| 6,200,716 | B1 | | 3/2001 | Fuller et al. |
| 6,207,334 | B1 | | 3/2001 | Dinh et al. |
| 6,255,027 | B1 | | 7/2001 | Wehelie et al. |
| 6,287,737 | B1 | | 9/2001 | Ong et al. |
| 6,913,863 | B2 | | 7/2005 | Wu et al. |
| 2003/0232265 | A1 | * | 12/2003 | Yamanami et al. ..... 430/65 |
| 2004/0126685 | A1 | * | 7/2004 | Horgan et al. ..... 430/58.3 |
| 2006/0204874 | A1 | * | 9/2006 | Ohkura et al. ..... 430/70 |
| 2007/0242979 | A1 | * | 10/2007 | Lin et al. ..... 399/159 |
| 2007/0243476 | A1 | * | 10/2007 | Lin et al. ..... 430/60 |
| 2007/0243477 | A1 | * | 10/2007 | Lin et al. ..... 430/60 |

OTHER PUBLICATIONS

Liang-Bih Lin et al., U.S. Appl. No. 11/403,981 on Improved Imaging Member, filed Apr. 13, 2006.

* cited by examiner

*Primary Examiner*—Christopher RoDee
*Assistant Examiner*—Peter L Vajda
(74) *Attorney, Agent, or Firm*—E. O. Palazzo

(57) ABSTRACT

A photoconductor containing a substrate, an undercoat layer thereover comprising a polyol resin, an aminoplast resin, a polyarylate, a siloxane modified polyarylate, an epoxy modified polyarylate, or a urethane modified polyarylate, or an amine modified polyarylate, and a metal oxide; a photogenerating layer, and at least one charge transport layer.

28 Claims, No Drawings

POLYARYLATE CONTAINING MEMBER

CROSS-REFERENCE TO RELATED APPLICATIONS

U.S. application Ser. No. 11/496,790, Publication No. 20080032219, the disclosure of which is totally incorporated herein by reference, on Polyester Containing Member, by Liang-Bih Lin et al.

U.S. application Ser. No. 11/496,915, Publication No. 20080032218, the disclosure of which is totally incorporated herein by reference, on Silanol Containing Photoconductor, by Jin Wu et al.

U.S. application Ser. No. 11/496,800, Publication No. 20080032216, the disclosure of which is totally incorporated herein by reference, on Phosphate Ester Containing Photoconductors, by Daniel V. Levy et al.

U.S. application Ser. No. 11/496,791, Publication No. 20080032220, the disclosure of which is totally incorporated herein by reference, on Silicone Free Polyester Containing Member, by Daniel V. Levy et al.

U.S. application Ser. No. 11/496,912, Publication No. 20080032217, filed concurrently herewith, the disclosure of which is totally incorporated herein by reference, on Phosphoric Acid Ester Containing Photoconductors, by Jin Wu et al.

Disclosed in copending application U.S. application Ser. No. 11/403,981, the disclosure of which is totally incorporated herein by reference, is an electrophotographic imaging member, comprising a substrate, an undercoat layer disposed on the substrate, wherein the undercoat layer comprises a polyol resin, an aminoplast resin, and a metal oxide dispersed therein; and at least one imaging layer formed on the undercoat layer, and wherein the polyol resin is, for example, selected from the group consisting of acrylic polyols, polyglycols, polyglycerols, and mixtures thereof.

The appropriate components and processes, number and sequence of the layers, component and component amounts in each layer, and the thicknesses of each layer of the above copending applications, filed concurrently herewith may be selected for the present disclosure photoconductors in embodiments thereof.

BACKGROUND

There are disclosed herein photoconductors containing adhesive promoting layers, and more specifically, photoconductors containing a hole blocking layer or undercoat layer (UCL) comprised, for example, of metal oxide particles, and at least one adhesion component that permits the excellent adhesion between, for example, the hole blocking layer and the layers thereover, such as the photogenerating layer and the charge transport layer or layers. More specifically, there are disclosed herein hole blocking layers comprised of a number of the components as illustrated in the copending applications referred to herein, such as a metal oxide like a titanium dioxide, a polyol, and a resin, such as a melamine resin and a polyarylate, an amine siloxane, an epoxy, or a urethane modified polyarylate adhesion promoter. In embodiments, a photoconductor comprised of a polyarylate hole blocking or undercoat layer enables, for example, excellent adhesion of the UCL to layers thereover thus avoiding or minimizing delamination; minimizing or substantially eliminating ghosting; and permitting compatibility with the photogenerating and charge transport resin binders, such as polycarbonates. Charge blocking layer and hole blocking layer are generally used interchangeably with the phrase "undercoat layer".

Also included within the scope of the present disclosure are methods of imaging and printing with the photoresponsive or the photoconductive devices illustrated herein. These methods generally involve the formation of an electrostatic latent image on the imaging member, followed by developing the image with a toner composition comprised, for example, of a thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members, photoconductor drums, and flexible belts disclosed herein can be selected for the Xerox Corporation iGEN3® machines that generate with some versions over 100 copies per minute. Processes of imaging, especially xerographic imaging and printing, including digital, and/or high speed color printing, are thus encompassed by the present disclosure.

The imaging members disclosed herein are in embodiments sensitive in the wavelength region of, for example, from about 400 to about 900 nanometers, and in particular from about 650 to about 850 nanometers, thus diode lasers can be selected as the light source.

REFERENCES

Illustrated in U.S. Pat. No. 6,913,863, the disclosure of which is totally incorporated herein by reference, is a photoconductive imaging member comprised of an optional supporting substrate, a hole blocking layer thereover, a photogenerating layer, and a charge transport layer, and wherein the hole blocking layer is comprised of a metal oxide, a mixture of phenolic resins, and wherein at least one of the resins contains two hydroxy groups.

Illustrated in U.S. Pat. Nos. 6,255,027; 6,177,219, and 6,156,468, each of the disclosures thereof being totally incorporated herein by reference, are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM®, available from OxyChem Company.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$ for each part of gallium chloride that is reacted; hydrolyzing the pigment precursor chlorogallium phthalocyanine Type I by standard methods, for example, by acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerating layer, and a charge transport layer, and wherein the blocking layer is comprised of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer, and a charge transport layer, and wherein the hole blocking layer is comprised of a crosslinked polymer generated, for example, from the reaction of a silyl-functionalized hydroxyalkyl polymer of Formula (I) with an organosilane of Formula (II) and water

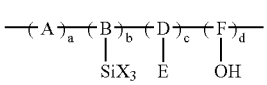

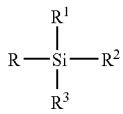

wherein, for example, A, B, D, and F represent the segments of the polymer backbone; E is an electron transporting moiety; X is selected, for example, from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Illustrated in U.S. Pat. No. 4,587,189, the disclosure of which is totally incorporated herein by reference, are photoconductive imaging members comprised of a supporting substrate, a charge transport layer, a photogenerating layer of BZP perylene, which is in embodiments comprised of a mixture of bisbenzimidazo(2,1-a-1',2'-b)anthra(2,1,9-def:6,5,10-d'e'f')diisoquinoline-6,11 -dione and bisbenzimidazo(2,1-a:2',1'-a)anthra(2,1,9-def:6,5,10-d'e'f') diisoquinoline-10,21-dione.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

An electrophotographic imaging member or photoconductor may be provided in a number of forms. For example, the imaging member may be a homogeneous layer of a single material such as vitreous selenium, or it may be a composite layer containing a photoconductor and another material. In addition, the imaging member may be layered. These layers can be in any order, and sometimes can be combined in a single or mixed layer. A number of photoconductors are disclosed in U.S. Pat. No. 5,489,496; U.S. Pat. No. 4,579,801; U.S. Pat. No. 4,518,669; U.S. Pat. No. 4,775,605; U.S. Pat. No. 5,656,407; U.S. Pat. No. 5,641,599; U.S. Pat. No. 5,344,734; U.S. Pat. No. 5,721,080; and U.S. Pat. No. 5,017,449, the entire disclosures of which are totally incorporated herein by reference. Also, photoreceptors are disclosed in U.S. Pat. No. 6,200,716; U.S. Pat. No. 6,180,309; and U.S. Pat. No. 6,207,334, the entire disclosures of which are totally incorporated herein by reference.

A number of undercoat or charge blocking layers are disclosed in U.S. Pat. No. 4,464,450; U.S. Pat. No. 5,449,573; U.S. Pat. No. 5,385,796; and, U.S. Pat. No. 5,928,824, the entire disclosures of which are totally incorporated herein by reference.

The demand for improved print quality in xerographic systems is increasing, especially with the advent of color. Common print quality issues can be dependent on the components of the undercoat layer (UCL). In certain situations, a thicker undercoat is desirable, but the thickness of the material used for the undercoat layer may be limited by, in some instances, the inefficient transport of the photoinjected electrons from the generator layer to the substrate. When the undercoat layer is too thin, then incomplete coverage of the substrate may result due to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting" resulting from, it is believed, the accumulation of charge somewhere in the photoreceptor. Removing trapped electrons and holes residing in the imaging members is a key to preventing ghosting. During the exposure and development stages of xerographic cycles, the trapped electrons are mainly at or near the interface between the charge generating layer (CGL) and the undercoating layer (UCL), and holes mainly at or near the interface between the charge generating layer and the charge transport layer (CTL). The trapped charges can migrate according to the electric field during the transfer stage, where the electrons can move from the interface of CGL/UCL to CTL/CGL, or the holes from CTL/CGL to CGL/UCL, and became deep traps that are no longer mobile. Consequently, when a sequential image is printed, the accumulated charge results in image density changes in the current printed image that reveals the previously printed image. Thus, there is a need to minimize or eliminate charge accumulation in photoreceptors without sacrificing the desired thickness of the undercoat layer, and a need for permitting the UCL to properly adhere to the other photoconductive layers, such as the photogenerating layer, for extended time periods, such as for example, 4,000,000 simulated xerographic imaging cycles.

Thick undercoat layers are desirable for photoreceptors as such layers permit photoconductor life extension and carbon fiber resistance. Furthermore, thicker undercoat layers permit the use of economical substrates in the photoreceptors. Examples of thick undercoat layers are disclosed in U.S. application Ser. No. 10/942,277, filed Sep. 16, 2004, U.S. Publication 20060057480, entitled "Photoconductive Imaging Members", the entire disclosure of which is totally incorporated herein by reference. However, due primarily to insufficient electron conductivity in dry and cold environments, the residual potential in conditions, such as 10 percent relative humidity and 70° F., can be high when the undercoat layer is thicker than 15 microns, and moreover, the adhesion of the UCL may be poor, disadvantages avoided or minimized with the UCL of the present disclosure.

SUMMARY

According to embodiments illustrated herein, there are provided photoconductors that enable excellent print quality, and wherein ghosting is minimized or substantially eliminated in images printed in systems with high transfer current, and where adhesion of the UCL is improved as compared to a number of UCLs with no adhesion promoter.

In particular, disclosed in embodiments is an electrophotographic imaging member, comprising a substrate, an undercoat layer contained on the substrate, wherein the undercoat layer comprises, for example, a polyol resin, an aminoplast resin, and a metal oxide dispersed therein, and at least one imaging layer formed on the undercoat layer, and wherein the undercoat layer contains at least one adhesion agent, component, or promoter; an electrophotographic imaging member, comprising a substrate, an undercoat layer disposed on the substrate, wherein the undercoat layer comprises an acrylic polyol resin, a melamine resin, a polyarylate, a siloxane modified polyarylate, a urethane modified polyarylate, an epoxy modified polyarylate, or an amine modified polyarylate adhesion component, and titanium oxide dispersed therein, and a photogenerating layer and charge transport layer formed on the undercoat layer; and an image forming apparatus for forming images on a recording medium comprising (a) an electrophotographic imaging member having a charge-retentive surface to receive an electrostatic latent image thereon, wherein the electrophotographic imaging member comprises a substrate, an undercoat layer disposed on the substrate, wherein the undercoat layer comprises a polyol resin, an aminoplast resin, an adhesion component, and a metal oxide dispersed therein, and at least one imaging layer, such as for example, a photogenerating layer and at least one charge transport layer formed on the undercoat layer; (b) a development component adjacent to the charge-retentive surface for applying a developer material to the charge-retentive surface to develop the electrostatic latent image to form a developed image on the charge-retentive surface, (c) a transfer component adjacent to the charge-retentive surface for transferring the developed image from the charge-retentive surface to a copy substrate; and (d) a fusing component adjacent to the copy substrate for fusing the developed image to the copy substrate.

DETAILED DESCRIPTION

Aspects of the present disclosure relate to a member comprising a substrate, an undercoat layer thereover wherein the undercoat layer comprises, for example, a polyol resin, an aminoplast resin, a polyarylate adhesion component, and a metal oxide dispersed therein; and at least one imaging layer formed on the undercoat layer; a photoconductor comprising a substrate, an undercoat layer thereover comprising a polyol resin, an aminoplast resin, a polyarylate, a siloxane modified polyarylate, an amine modified polyarylate, an epoxy modified polyarylate, a urethane modified polyarylate adhesion component, and a metal oxide; a photoconductor comprising an optional supporting substrate, a hole blocking layer thereover comprising a polyol resin, an aminoplast resin, a polyarylate, and a metal oxide, a photogenerating layer and a charge transport layer; a photoconductor wherein the photogenerating layer is situated between the charge transport layer and the substrate, and which layer contains a resin binder; and wherein the adhesion component is a polyarylate or a siloxane modified polyarylate present in an amount of, for example, from about 0.1 to about 25 weight percent; a photoconductive member comprising a substrate; a layer thereover comprised of a polyol resin, an aminoplast resin, a polyarylate adhesion component, and a metal oxide; and at least one imaging layer formed on the undercoat layer wherein the imaging layer is comprised of, for example, a photogenerating layer and at least one charge transport layer; photoconductor comprising a substrate; a layer thereover comprising a polyol resin, an aminoplast resin, at least one of a polyarylate, and a siloxane modified polyarylate and a metal oxide; a photogenerating layer; and a charge transport layer; and a photoconductor comprising a polyarylate, metal oxide containing layer, a photogenerating layer, and a charge transport layer.

According to embodiments there is disclosed an electrophotographic imaging member which generally comprises a substrate layer, an undercoat layer, and an imaging layer. The undercoat layer is generally located between the substrate and the imaging layer, although additional layers may be present, and located between these layers. The imaging member may also include a charge generating layer and a charge transport layer. This imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Examples of adhesion additives, components, or promoters selected in various suitable amounts, such as for example, from about 0.1 to about 40, from about 1 to about 20, or from 3 to about 10 weight percent, include polyarylates; polyarylates of heterochain polyesters of dihydric phenols; poly 4,4'-isopropylidenediphenylene terephthalate/isophthalate copolymers; siloxane modified polyarylates such as polyarylate-organosiloxanes, described in *Polyarylates, Synthesis and Properties*, Russian Chemical Reviews 63(10), 833-851 (1994), the disclosure of which is totally incorporated herein by reference, where polycondensation methods permit a variance in the position of the block copolymers, and which can differ in their structure and properties from regular polyarylates, in particular, for example, polyarylate-dimethylsiloxane copolymers have two glass transition temperatures corresponding to a polydimethylsiloxane (about −120° C.) and the polyarylate (320° C. for a phenolphthalein terephthalic acid polyarylate), and with other properties, such as excellent mechanical strength and elasticity, ARDEL™ U-100, obtained from Toyota Hsutsu Inc. of Japan, and believed to be a copolymer of terephthalic acid, isophthalic acid, and bisphenol A; polyarylate-polyester, such as VETRAN™ A950 resin, available from Celanese Acetate LLC, which, due to its liquid crystal structure, possesses high tensile properties and low thermal shrinkage; epoxy modified polyarylate; urethane modified polyarylates, such as EFKA™ 4406, available from Ciba Specialty Chemicals; polyarylate with a 9,10-dihydrophenanthrene-2,7-dicarbonylate moiety, such as poly[oxy-1,4-phenylene(1-methylethylidene)-1,4-phenyleneoxycarbonyl(9,10-dihydro-2,7-phenanthrenediyl)-carbonyl] (I) which was synthesized by palladium catalyzed carbonylation-poly-condensation with 2,7-dibromo-9,10-dihydrophenanthrene and bisphenol-A; polyarylate (I) obtained in 95 percent yield with a high molecular weight (polystyrene equivalent $M_w$=102,600) under optimum conditions, and which was highly heat-resistant and soluble in organic solvents, such as chlorobenzene, dichloromethane, and chloroform. The initial thermal degradation temperatures of the polyarylate (I) are about 332° C. to 420° C. in the air atmosphere and about 420° C. to 483° C. under a nitrogen stream.

The amount of the adhesion component, such as a polyarylate, siloxane urethane, or epoxy polyarylate, with examples of a number of other adhesion components being illustrated in the copending applications being filed concurrently herewith, is, for example, from about 0.01 to about 40 weight percent, from about 0.1 to about 20 weight percent, or from about 1 to about 10 weight percent, and with, for example, a weight average molecular weight ($M_w$) of from about 1,000 to about 100,000, a number average molecular weight ($M_n$) of from about 150 to about 3,000, and a polydispersity of from about 1 to about 2.

In embodiments, the polyol resin selected for the UCL is acrylic polyol resin. Other polyol resins that may be used are selected from, but are not limited to, the group comprised of polyglycol, polyglycerol, and mixtures thereof. The aminoplast resin may be selected from, but are not limited to, the group comprised of urea, melamine, and mixtures thereof. In embodiments, a metal oxide is included in the UCL in combination with the resins to form the undercoat layer formulation. For example, the metal oxide is dispersed in the resins and the dispersion is subjected to heat. In embodiments, the metal oxide is of a size diameter of from about 5 to about 300 nanometers, and possesses a powder resistance of from about $1\times10^3$ to about $6\times10^5$ ohm/cm when applied at a pressure of from about 50 to about 650 kilograms/cm$^2$.

Suitable polyester additives that function primarily as adhesion promoters generally comprise, for example, the reaction product of (a) at least one difunctional carboxylic acid; (b) at least one trifunctional polyol; (c) at least one chain stopper, and (d) a phosphoric acid. Examples of suitable difunctional carboxylic acids of (a) include adipic acid, azelaic acid, fumaric acid, phthalic acid, sebacic acid, maleic acid, succinic acid, isophthalic acid, tetrahydrophthalic acid, hexahydrophthalic acid, dimer fatty acids, itaconic acid, glutaric acid, cyclohexanedicarboxylic acid, and mixtures thereof. Specific difunctional carboxylic acids of value are adipic acid and azelaic acid.

The at least one, such as for example, from 1 to about 8, 1 to about 4, or 1, trifunctional polyol (a) may be branched or unbranched. Examples of suitable trifunctional polyols (b) are trimethylolpropane, trimethylol ethane, glycerin, 1,2,4-butanetriol, mad mixtures thereof. The at least one chain stopper can be a carboxylic acid that is different from the at least one difunctional carboxylic acid (a), and more specifically, the chain stopper can be comprised of monocarboxylic acids. Suitable carboxylic acids (c) can contain one or more aromatic structures and also can contain a number of branched alkyl groups. Specific examples of suitable carboxylic acids (c) include para-t-butyl benzoic acid, benzoic acid, salicylic acid, 2-ethylhexanoic acid, pelargonic acid, isononanoic acid, $C_{18}$ fatty acids, stearic acid, lauric acid, palmitic acid, and mixtures thereof. At least one refers, for example, to 1 to about 10, from 1 to about 5, from 1 to about 3, and 1. The phosphoric acid component (d) should be present in amounts of from about 0.03 to about 0.20, from about 0.05 to about 0.15, or from about 0.07 to about 0.10 weight percent. Phosphate esters, such as butyl or phenyl acid phosphate and the like, including a number of known phosphate esters, are suitable for use as component (d).

The at least one trifunctional polyol (b) may be branched or unbranched. Examples of suitable trifunctional polyols (b) are trimethylolpropane, trimethylolethane, glycerin, 1,2,4-butanetriol, and mixtures thereof. Specific trifunctional polyls that are selected for a number of the photoconductors disclosed herein are trimethylolpropane and trimethylolethane, and mixtures thereof.

Examples of polyol resins include PARALOID™ AT-400 with a $M_w$ of 15,000, a hydroxyl equivalent weight of 652 and an acid number of 25; PARALOID™ AT-410 with a $M_w$ of 9,000, a hydroxyl equivalent weight of 877 and an acid number of 25; RU-1100-1k™ with a $M_n$ of 1,000 and 112 hydroxyl value, and RU-1550-k5™ with a $M_n$ of 5,000 and 22.5 hydroxyl value, both available from Procachem Corp.; G-CURE™ 108A70, available from Fitzchem Corp.; NEOL® based polyester polyol, available from BASF; TONE™ 0201 polyol with a $M_n$ of 530, a hydroxyl number of 117, and acid number of <0.25, available from Dow Chemical Company. Examples of aminoplast resins include SUMIMAL™ M40S, SUMIMAL™ M50S, both available from Sumitomo Chemical, CYMEL™ 323, CYMEL™ 327, CYMEL™ 303, all available from CYTEC Corporation, and GP 401W51™, available from Georgia-Pacific.

In embodiments, the undercoat layer metal oxide like $TiO_2$ can be either surface treated or untreated. Surface treatments include, but are not limited to, mixing the metal oxide with aluminum laurate, alumina, zirconia, silica, silane, methicone, dimethicone, sodium metaphosphate, and the like, and mixtures thereof. Examples of $TiO_2$ include MT-150W™ (surface treatment with sodium metaphosphate, available from Tayca Corporation), STR-60N™ (no surface treatment, available from Sakai Chemical Industry Co., Ltd.), FTL-100™ (no surface treatment, available from Ishihara Sangyo Laisha, Ltd.), STR-60™ (surface treatment with $Al_2O_3$, available from Sakai Chemical Industry Co., Ltd.), TTO-55N™ (no surface treatment, available from Ishihara Sangyo Laisha, Ltd.), TTO-55A™ (surface treatment with $Al_2O_3$, available from Ishihara Sangyo Laisha, Ltd.), MT-150AW™ (no surface treatment, available from Tayca Corporation), MT-150A™ (no surface treatment, available from Tayca Corporation), MT-100S™ (surface treatment with aluminum laurate and alumina, available from Tayca Corporation), MT-100HD™ (surface treatment with zirconia and alumina, available from Tayca Corporation), MT-100SA™ (surface treatment with silica and alumina, available from Tayca Corporation), and the like.

Examples of the hole blocking layer components include a $TiO_2$/VARCUM® resin mixture in a 1:1 mixture of n-butanol:xylene containing from about 2 to about 50 weight percent of an added electron transport material based on the total solid concentration in solution, and wherein the aforementioned main component mixture amount is, for example, from about 80 to about 100, and more specifically, from about 90 to about 99 weight percent, and yet more specifically, wherein the titanium oxide possesses a primary particle size diameter of from about 10 to about 25 nanometers, and more specifically, from about 12 to about 17, and yet more specifically, about 15 nanometers with an estimated aspect ratio of from about 4 to about 5, and is optionally surface treated with, for example, a component containing, for example, from about 1 to about 3 percent by weight of alkali metal, such as a sodium metaphosphate, a powder resistance of from about $1\times10^4$ to about $6\times10^4$ ohm/cm when applied at a pressure of from about 650 to about 50 kilograms/$cm^2$; MT-150W™, and which titanium oxide is available from Tayca Corporation, and wherein the hole blocking layer is of a suitable thickness thereby avoiding or minimizing charge leakage. Metal oxide examples in addition to titanium are chromium, zinc, tin, and the like, and more specifically, zinc oxide, tin oxide, aluminum oxide, silicone oxide, zirconium oxide, indium oxide, molybdenum oxide, and mixtures thereof.

The hole blocking layer can in embodiments be prepared by a number of known methods; the process parameters being dependent, for example, on the photoconductor member desired. The hole blocking layer can be coated as solution or a dispersion onto a substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 1 to about 15 microns after drying.

The weight/weight ratio of the polyol and aminoplast resins in the undercoat layer formulation is, for example, from about 5/95 to about 95/5, or from about 25/75 to about 75/25. The weight/weight ratio of the polyol and aminoplast resins to the metal oxide like titanium oxide in the undercoat layer formulation is from about 10/90 to about 90/10, or from about 30/70 to about 70/30. In embodiments, the aminoplast resin is present in an amount of from about 5 percent to about 80 percent, or from about 5 percent to about 75 percent, or from about 20 percent to about 80 percent by weight of the total weight of the undercoat layer components. In embodiments, the polyol resin is present in an amount of from about 5 percent to about 80 percent, from about 5 percent to about 75 percent, or from about 20 percent to about 80 percent by weight of the total weight of the undercoat layer components, and the metal oxide like $TiO_2$ is present in an amount of from about 10 percent to about 90 percent, or from about 20 percent to about 80 percent by weight of the total weight of the undercoat layer.

Optionally, the undercoat layer further contains a light scattering particle or particles with, for example, a refractive index different from the resin mixture binder, and which particles possess a number average particle size greater than about 0.8 μm. The light scattering particles, which can be an amorphous silica or a silicone ball, are present in an amount of, for example, from about 0 percent to about 10 percent by weight of the total weight of the undercoat layer.

The undercoat layer has a suitable thickness of, for example, from about 0.1 μm to about 40 μm, from about 2 μm to about 25 μm, or from about 10 μm to about 20 μm, and wherein the resins/metal oxide combination is present in an amount of from about 20 percent to about 80 percent, or from about 40 percent to about 70 percent, based on the total weight of the undercoat layer components. The undercoat layer with a thickness of 0.1 to about 40 microns may be applied or coated onto a substrate by any suitable known technique, such as spraying, dip coating, draw bar coating, gravure coating, silk screening, air knife coating, reverse roll coating, vacuum deposition, chemical treatment, and the like. Additional vacuuming, heating, drying and the like may be used to remove any solvent remaining after the application or coating to form the undercoat layer.

Alternative optional hole blocking or undercoat layer components for the imaging members of the present disclosure can contain a number of components in addition to the resins, and polyester or polyacrylate adhesion component, including for example, known hole blocking components, such as amino silanes, doped metal oxides, TiSi, a metal oxide like chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4 '-ethylidenebisphenol), F (bis(4-hydroxyphenyl)methane), M (4,4'-(1,3 -phenylenediisopropylidene)bisphenol), P (4,4'-(1,4-phenylenediisopropylidene) bisphenol), S (4,4'-sulfonyldiphenol), and Z (4,4'-cyclohexylidenebisphenol); hexafluorobisphenol A (4,4'-(hexafluoro isopropylidene)diphenol), resorcinol, hydroxyquinone, catechin, and the like.

Thus, the hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene) bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Borden Chemical).

The thickness of the photoconductive substrate layer depends on many factors including economical considerations, electrical characteristics, and the like; thus, this layer may be of substantial thickness, for example over 3,000 microns, such as from about 300 to about 700 microns, or of a minimum thickness. In embodiments, the thickness of this layer is from about 75 microns to about 300 microns, or from about 100 to about 150 microns.

The substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors including strength desired and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, substrates selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of, for example, a number of know photogenerating pigments including, for example, Type V hydroxygallium phthalocyanine or chlorogallium phthalocyanine, and a resin binder like poly(vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts of, for example from about 1 to about 50, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly (vinyl alcohol), polyacrylonitrile, polystyrene, and the like. It is desirable to select a coating solvent that does not substantially disturb or adversely affect the other previously coated layers of the device. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicone and compounds of silicone and germanium, carbon, oxygen, nitrogen, and the like fabricated by vacuum evaporation or deposition. The photogenerating layer may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

Since infrared sensitivity is usually desired for photoreceptors exposed to low-cost semiconductor laser diode light exposure devices, a number of phthalocyanines can be selected for the photogenerating layer, and where, for example, the absorption spectrum and photosensitivity of the phthalocyanines depends on the central metal atom of the compound, such as oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine. The phthalocyanines exist in many crystal forms, and have a strong influence on photogeneration.

Examples of polymeric binder materials that can be selected as the matrix for the photogenerating layer components are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The coating of the photogenerating layer on the UCL in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. The hole blocking layer or UCL may be applied to the electrically conductive supporting substrate surface prior to the application of a photogenerating layer.

A suitable known adhesive layer can be included in the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. As optional adhesive layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicone nitride, carbon black, and the like, to provide, for example, in embodiments of the present disclosure, further desirable electrical and optical properties.

A number of charge transport materials, especially known hole transport molecules, may be selected for the charge transport layer, examples of which are aryl amines of the formula/structure, and which layer is generally of a thickness of from about 5 microns to about 75 microns, and more specifically, of a thickness of from about 10 microns to about 40 microns

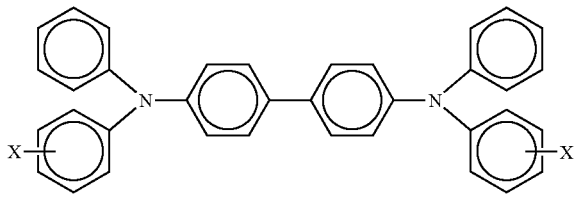

wherein X is a suitable hydrocarbon like alkyl, alkoxy, and aryl; a halogen, or mixtures thereof, and especially those substituents selected from the group consisting of Cl and $CH_3$; and molecules of the following formula

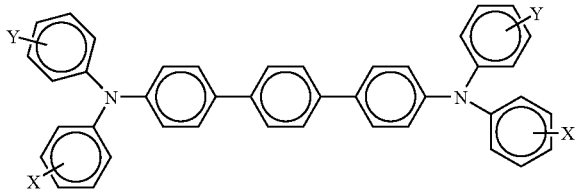

wherein X and Y are a suitable substituent like a hydrocarbon, such as independently alkyl, alkoxy, or aryl; a halogen, or mixtures thereof. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments. At least one charge transport refers, for example, to 1, from 1 to about 7, from 1 to about 4, and from 1 to about 2.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N '-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4 "-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4 -isopropylphenyl)-[p-terphenyl]-4,4"-diamine, N,N'-bis(4-butylphenyl)-N,N'-bis-(2 -ethyl-6-methylphenyl)-[p-terphenyl]-4,4"-diamine, N,N'-bis(4 -butylphenyl)-N,N'-bis-(2,5-dimethylphenyl)-[p-terphenyl]-4,4'-diamine, N,N'-diphenyl-N,N'-bis(3-chlorophenyl) -[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer or layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4 '-isopropylidene-diphenylene)carbonate (also referred to as bisphenol-A-polycarbonate), poly(4,4 '-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting small molecules for the charge transport layer include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis (4-butylphenyl)-N,N '-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4 "-diamine, N,N'-bis(4-butylphenyl)-N,N'-bis-(4-isopropylphenyl)-[p-terphenyl]-4,4"-diamine, N,N'-bis(4 -butylphenyl)-N,N'-bis-(2-ethyl-6-methylphenyl)-[p-terphenyl]-4,4"-diamine, N,N'-bis(4 -butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N -methyl-3-(9-ethyl)carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. In embodiments, to minimize cycle-up in printers with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3 -methylphenyl)-(1,1'-biphenyl)-4,4'-diamine, N,N'-bis(4-butylphenyl)-N,N '-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4 -butylphenyl)-N,N'-bis-(2-ethyl-6-methylphenyl)-[p-terphenyl]-4,4"-diamine, N,N'-bis(4 -butylphenyl)-N,N'-bis-(2,5-dimethylphenyl)-[p-terphenyl]-4,4"-diamine, and N,N'-diphenyl-N,N '-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 to about 75, from about 15 to about 50 micrometers, but thicknesses outside these ranges may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 micrometers. In embodiments, this thickness for each layer can be, for example, from about 1 micrometer to about 5 micrometers. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

The following Examples are provided. All proportions are by weight unless otherwise indicated.

The Examples set forth herein below are illustrative of different compositions and conditions that can be used with all proportions being by weight unless otherwise indicated.

COMPARATIVE EXAMPLE 1

A conventional undercoat layer dispersion, known as UC79, was prepared as follows: in a 4 ounce glass bottle, 16.7 grams of $TiO_2$ (MT-150W™, Tayca Company, Japan), 5.2 grams of phenolic resin (VARCUM™ 29159, Oxychem Company), and 5.3 grams of the melamine resin (CYMEL™ 323, CYTEC Company) were mixed with 15 grams of xylene and 15 grams of n-butanol. After mixing, 120 grams of 0.4 to 0.6 millimeter diameter zirconium oxide beads were added, and roll milled overnight, about 18 to 20 hours. The reference comparative device or photoconductor was prepared by coating the undercoat layer dispersion with a 5 μm thickness (UCL thickness) at a curing condition of 140° C./30 minutes onto an aluminum drum substrate. A 0.2 to 0.5 μm thick charge generating layer comprised of chlorophthalocyanine and a 29 μm thick charge transport layer comprised of N,N'-bis(methylphenyl)-1,1-biphenyl-4,4'-diamine, a polycarbonate (PCZ, a LUPILON 200™ (PCZ-200) or POLYCARBONATE Z™, weight average molecular weight of about 20,000, available from Mitsubishi Gas Chemical Corporation), and polytetrafluoroethylene (PTFE) particles were coated on the UCL.

COMPARATIVE EXAMPLE 2

A photoconductor was prepared by coating an undercoating layer dispersion comprising a silane, $Zr(acac)_2$, and polyvinyl butyral, at 1 μm thickness, and at a curing condition of 115° C./30 minutes on an aluminum drum. Subsequently, a 0.2 to 0.5 μm thick charge generating layer comprised of chlorophthalocyanine and a 29 μm thick charge transport layer comprised of N,N'-bis(methylphenyl)-1,1 -biphenyl-4,4'-diamine, a polycarbonate (PCZ), and PTFE particles were coated on the UCL.

EXAMPLE I

An undercoat layer dispersion was prepared by mixing 18.5 grams of titanium oxide (MT-150W™, Tayca Co., Japan), 6.25 grams of CYMEL™ 323 melamine resin (CYTEC Company), 6 grams of PARALOID™ AT-400 acrylic polyol resin (Rohm Haas), 0.3 grams of adhesion additive ARDEL™ U-100, available from Toyota Hsutsu Inc. of Japan, and believed to be a polyarylate, and more specifically, a copolymer of terephthalic acid, isophthalic acid, and bisphenol A with a mole ratio of 1/1/2, and a softening point temperature of 175° C., and 32 grams of methylethyl ketone (MEK) in a 4 ounce glass bottle. After mixing, 140 grams of 0.4 to 0.6 millimeter $ZrO_2$ beads were added and roll milled for two days. The final dispersion was collected through a 20 μm nylon filter, and the final solid percentage was measured to be 42.5 percent. An experimental device was prepared by coating the above prepared undercoat layer, 5 μm thick, at a curing condition of 140° C./30 minutes onto an aluminum drum. Subsequently, a 0.2 to 0.5 μm thick charge generating layer comprised of chlorophthalocyanine and a 29 μm thick charge transport layer comprised of N,N'-bis(methylphenyl)-1,1-biphenyl-4,4'-diamine, a polycarbonate (PCZ), and PTFE particles were coated on the UCL.

EXAMPLE II

The UCL of Example I was prepared with the exception that the ARDEL™ U-100 was added in an amount of 0.5 grams. An experimental device was prepared by coating the undercoat layer with a 5 millimeters thickness at a curing condition of 145° C./30 minutes on an aluminum drum. Subsequently, a 0.2 to 0.5 millimeter thick charge generating layer comprised of chlorogalliumphthalocyanine, and a 29 millimeters thick charge transport layer comprised of N,N'-bis(methylphenyl)-1,1-biphenyl-4,4'-diamine, a polycarbonate (PCZ), and PTFE particles were coated on the UCL and dried at 115° C./40 minutes.

The above prepared photoreceptor devices were tested in a scanner set to obtain photoinduced discharge characteristic (PIDC) curves, sequenced at one charge-erase cycle followed by one charge-expose-erase cycle, wherein the light intensity was incrementally increased with cycling to produce a series of PIDC curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters. The exposure light source was a 780 nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50 percent relative humidity and about 22° C.).

Very similar PIDC curves were observed for the above photoreceptor devices, thus the undercoat layer containing the ARDEL™ adhesive additive performs very similarly to a photoconductor with the Comparative Examples undercoat layer, and the undercoat layer with only the polyol and melamine resins of Comparative Example 2 from the point of view of PIDC. The Examples I and II devices showed normal electrical properties with similar residual voltage and charge acceptance to that of the Comparative devices. The $V_{dep}$, $V_{low}$, dV/dX, $V_{erase}$, and dark decay characteristics indicate that the undercoat layer of Example I is functioning properly.

The above photoreceptor drums were then acclimated for 24 hours before testing (70° F./10 percent RH) in a Xerox Corporation Copeland Work Centre Pro 3545 machine using K station at t=0 and t=500 print count. Runups from t=0 to t=500 prints for all devices were completed in one of the CYM color stations. Ghosting levels were measured against a TSIDU SIR scale. The stressful combination of Kutani CRUM and Tokai BCR was used for evaluating ghosting in the devices.

The ghosting tests revealed that the ARDEL™ polyarylate containing undercoat layer photoconductors had ghosting levels of G1 at t=1 and G3 at t=500, which are improved as compared to the levels typically observed from devices comprised of the known organozirconium based undercoat layer where ghosting is usually G6 even at t=0, and similar to that of the undercoating layer without the polyarylate resin as in Comparative Example 2. The ghosting tests also revealed that the photoconductor of Examples I and II had improved performance as compared to conventional undercoat layer with UC79, which is typically G3 at t=0 and G4-4.5 at t=500, under the same stress conditions. Therefore, incorporation of polyol, melamine resins, and the polyarylate adhesion promoter in combination with a metal oxide, such as titanium oxide, in the undercoat layer improved print quality by minimizing ghosting. These results show that the Example I and II undercoat layer formulation photoconductors exhibit essentially zero or low ghosting images even at severe testing conditions.

The undercoating layers in Comparative Examples 1 and 2 allowed the adhesion between the UCLs and top layers. By incorporating the polyarylate, the adhesion improved from G3 to G1.5, based on a crosshatch peel test, to that of the comparative devices without the polyarylate. The crosshatch peel test utilizes a utility knife to cut a crosshatch pattern of about 4 to 6 millimeters grid spacing on the full device, and then adhering a piece of 1 inch Scotch tape to the pattern, and peeling off the tape. The grading is based on the amount of residuals left on the tape, with G1 almost no residue to G5 almost everything is removed.

Alternatively, the adhesion promoter in the above Examples can be selected from the following classes of materials: siloxane modified polyarylates, such as polyarylate-organosiloxanes, which are described in *Polyarylates, Synthesis and Properties*, Russian Chemical Reviews 63(10), 833-851 (1994), where polycondensation allowed variance in the position of the block copolymers, and which differ in their structure and properties from simple polyarylates, in particular, for example, polyarylate-dimethylsiloxane copolymers with two glass transition temperatures corresponding to the polydimethylsiloxane (−120° C.) and the polyarylate (320° C. in the case of the phenolphthalein terephthalic acid polyarylate), but with other suitable properties, such as mechanical strength and elasticity, showing combination effects, and which also differ from each homopolymer or polyarylate-siloxane block copolymers; polyarylate-polyester, such as VETRAN™ A950 resin, available from Celanese Acetate LLC, which, due to its liquid crystal structure, possesses high tensile properties and low thermal shrinkage; epoxy modified polyarylates; urethane modified polyarylates, such as EFKA™ 4406, available from Ciba Specialty Chemicals; polyarylate with 9,10-dihydrophenanthrene-2,7-dicarbonylate moiety, such as poly[oxy-1,4-phenylene(1-methylethylidene)-1,4 -phenyleneoxycarbonyl(9,10-dihydro-2,7-phenanthrenediyl)-carbonyl] (I), which was synthesized by palladium catalyzed carbonylation-poly-condensation with 2,7-dibromo-9,10-dihydrophenanthrene and bisphenol-A; polyarylate (I) and obtained in 95 percent yield with a high molecular weight (polystyrene equivalent $M_w$=102,600), and the like, and mixtures thereof. The initial thermal degradation temperatures of the polyarylate (I) are from about 332° C. to about 420° C. in air, and from about 420° C. to about 483° C. under a nitrogen stream; this polyarylate exhibits a dynamic viscoelastic behavior like a typical amorphous polymer.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate; an undercoat layer thereover comprising a polyol resin, an aminoplast resin, a polyarylate, and a metal oxide; a photogenerating layer; and at least one charge transport layer, and wherein said polyarylate enables substantial permanent adhesion of said undercoat layer to said substrate and said photogenerating layer, and wherein said polyarylate is present in an amount of from about 0.1 to about 40 weight percent; and wherein said polyarylate is at least one of a siloxane polyarylate, an amine polyarylate, an epoxy polyarylate, and a urethane polyarylate.

2. A photoconductor in accordance with claim 1 wherein the polyol resin is selected from the group consisting of acrylic polyols, polyglycols, polyglycerols, and mixtures thereof.

3. A photoconductor in accordance with claim 1 wherein the aminoplast resin is selected from the group consisting of melamine, urea, and mixtures thereof.

4. A photoconductor in accordance with claim 1 wherein the metal oxide is selected from the group consisting of zinc oxide, tin oxide, aluminum oxide, silicone oxide, zirconium oxide, indium oxide molybdenum oxide, and mixtures thereof.

5. A photoconductor in accordance with claim 1 wherein the metal oxide possesses a size diameter of from about 5 to about 300 nanometers, a powder resistance of from about $1\times10^3$ to about $6\times10^5$ ohm/cm when applied at a pressure of from about 50 to about 650 kilograms/$cm^2$.

6. A photoconductor in accordance with claim 1 wherein the metal oxide is titanium dioxide.

7. A photoconductor in accordance with claim 1 wherein the polyarylate possesses a $M_w$ of 1,000 to about 100,000, and a $M_n$ of from about 200 to about 6,000.

8. A photoconductor in accordance with claim 1 wherein said polyarylate is present in an amount of from 0.1 to about 20 weight percent.

9. A photoconductor in accordance with claim 1 wherein said polyarylate is present in an amount of from 1 to about 12 weight percent.

10. A photoconductor in accordance with claim 1 wherein said polyarylate possesses a weight average molecular weight of from about 25,000 to about 75,000; and a $M_n$ of from about 500 to about 4,000.

11. A photoconductor in accordance with claim 1 wherein each of said metal oxide, said polyol, and said aminoplast are present in an amount of from about 20 percent to about 80 percent by weight of the total weight of the undercoat layer components, and wherein the total thereof is about 100 percent by weight inclusive of said polyarylate.

12. A photoconductor in accordance with claim 1 wherein said photoconductor is a drum or a flexible belt, and wherein said substrate is comprised of an insulating component, or a conductive component.

13. A photoconductor in accordance with claim 1 wherein said at least one charge transport layer is from 1 to about 7 layers.

14. A photoconductor in accordance with claim 1 wherein said at least one charge transport layer is from 1 to about 3 layers.

15. A photoconductor in accordance with claim 1 wherein said at least one charge transport layer is 1.

16. A photoconductor in accordance with claim 1 wherein said at least one charge transport layer is comprised of a hole transport component and a resin binder, and said photogenerating layer is comprised of at least one photogenerating pigment and a resin binder.

17. A photoconductor in accordance with claim 1 wherein said polyarylate is a silicone modified polyarylate organosiloxane.

18. A photoconductor in accordance with claim 1 wherein said charge transport layer is comprised of aryl amine molecules of the formula

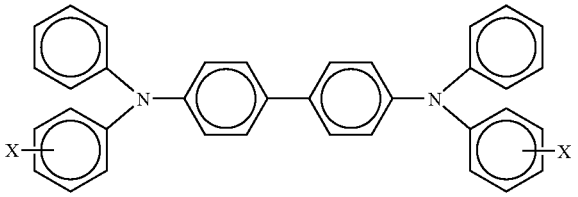

wherein X is selected from the group consisting of at least one of alkyl, alkoxy, aryl, and halogen.

19. A photoconductor in accordance with claim 18 wherein said alkyl and said alkoxy each contains from about 1 to about 12 carbon atoms, and said aryl contains from about 6 to about 36 carbon atoms.

20. A photoconductor in accordance with claim 18 wherein said aryl amine is N,N'-diphenyl-N,N-bis(3-methylphenyl)-1,1 '-biphenyl-4,4'-diamine.

21. A photoconductor in accordance with claim 1 wherein said charge transport layer is comprised of molecules of the formula

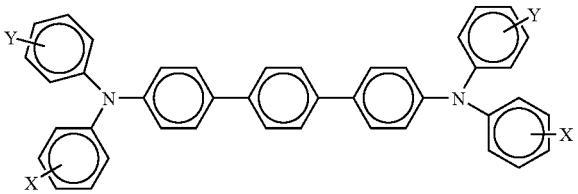

wherein X and Y are independently selected from the group consisting of at least one of alkyl, alkoxy, aryl, and halogen.

22. A photoconductor in accordance with claim 21 wherein alkyl and alkoxy each contains from about 1 to about 12 carbon atoms, and aryl contains from about 6 to about 36 carbon atoms.

23. A photoconductor in accordance with claim 21 wherein said molecules are selected from the group consisting of at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis-(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4 "-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

24. A photoconductor in accordance with claim 1 wherein said photogenerating layer is comprised of a photogenerating pigment or photogenerating pigments.

25. A photoconductor in accordance with claim 24 wherein said photogenerating pigment is comprised of at least one of a metal phthalocyanine, a metal free phthalocyanine, a titanyl phthalocyanine, a halogallium phthalocyanine, and a perylene.

26. A photoconductor in accordance with claim 24 wherein said photogenerating pigment is comprised of chlorogallium phthalocyanine, or wherein said photogenerating pigment is comprised of hydroxygallium phthalocyanine.

27. A photoconductor comprising a substrate; an undercoat layer thereover comprising a polyol resin, an aminoplast resin, a polyarylate, and a metal oxide; a photogenerating layer; and at least one charge transport layer, and wherein said polyarylate enables substantial permanent adhesion of said undercoat layer to said substrate and said photogenerating layer, and wherein said polyarylate is present in an amount of from about 0.1 to about 40 weight percent; and wherein said polyarylate is at least one of a siloxane modified polyarylate, an epoxy modified polyarylate, a urethane modified polyarylate, and an amine modified polyarylate, and wherein said metal oxide is dispersed therein.

28. A photoconductor in accordance with claim 27 wherein said siloxane modified polyarylate is a polyarylate-siloxane block copolymer.

* * * * *